US011582849B2

(12) United States Patent
Veldman et al.

(10) Patent No.: US 11,582,849 B2
(45) Date of Patent: Feb. 14, 2023

(54) LED DRIVER FOR LED LIGHTING UNITS FOR REPLACING A HIGH-INTENSITY DISCHARGE LAMP

(71) Applicant: SIGNIFY HOLDING B.V., Eindhoven (NL)

(72) Inventors: Paul Robert Veldman, Oss (NL); Marcus Cornelis Van Meel, Helmond (NL); Jie Fu, Shanghai (CN); Zhiquan Chen, Shanghai (CN); Raimundo De Heer Galisteo, Uden (NL); Yuanqiang Liu, Shanghai (CN); Shiguang Sun, Shanghai (CN); Gang Wang, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/431,503

(22) PCT Filed: Feb. 18, 2020

(86) PCT No.: PCT/EP2020/054247
§ 371 (c)(1),
(2) Date: Aug. 17, 2021

(87) PCT Pub. No.: WO2020/169608
PCT Pub. Date: Aug. 27, 2020

(65) Prior Publication Data

US 2022/0141934 A1 May 5, 2022

(30) Foreign Application Priority Data

Feb. 20, 2019 (WO) ..... PCT/CN2019/075605
Apr. 4, 2019 (EP) ..... 19167246

(51) Int. Cl.
*H05B 45/30* (2020.01)
*H05B 45/46* (2020.01)
(Continued)

(52) U.S. Cl.
CPC ..... *H05B 45/46* (2020.01); *H05B 45/355* (2020.01); *H05B 45/3578* (2020.01); *H05B 45/375* (2020.01); *H05B 45/38* (2020.01)

(58) Field of Classification Search
CPC ..... H05B 41/14; H05B 41/2886; H05B 41/3924; H05B 41/3927; H05B 41/3928;
(Continued)

(56) References Cited

U.S. PATENT DOCUMENTS 8,497,637 B2 * 7/2013 Liu ..... H05B 45/37 315/225
9,621,029 B2 * 4/2017 Gritti ..... H02M 1/4258
(Continued)

FOREIGN PATENT DOCUMENTS

EP 3050399 A1 8/2016
WO 2015044311 A1 4/2015
WO 2018127376 A1 7/2018

*Primary Examiner* — Tung X Le

(57) ABSTRACT

An LED driver that is operable with two different types of power source originally designed for a high-intensity discharge lamp. The LED driver directs current of an input power provided by the power source down a first current path if it is determined that the power source comprises a functional ignitor. The LED driver directs current of an input power provided by the power source down a second current path if it is determined that the 5 power source does not comprise a functional ignitor.

12 Claims, 5 Drawing Sheets

(51) Int. Cl.
*H05B 45/3578* (2020.01)
*H05B 45/38* (2020.01)
*H05B 45/355* (2020.01)
*H05B 45/375* (2020.01)

(58) Field of Classification Search
CPC ..... H05B 45/32; H05B 45/37; H05B 45/345; H05B 45/355; H05B 45/375
See application file for complete search history.

(56) References Cited

U.S. PATENT DOCUMENTS

| | | | | |
|---|---|---|---|---|
| 9,769,894 | B2 * | 9/2017 | Chowdhury | H05B 45/10 |
| 2009/0295776 | A1 * | 12/2009 | Yu | H05B 45/46 345/212 |
| 2010/0295478 | A1 * | 11/2010 | Wei | H05B 45/10 315/307 |
| 2013/0320869 | A1 | 12/2013 | Jans et al. | |
| 2014/0175997 | A1 * | 6/2014 | Wu | H05B 45/395 315/200 R |
| 2014/0239834 | A1 * | 8/2014 | Choi | H05B 45/375 315/205 |
| 2016/0161103 | A1 | 6/2016 | Ramaiah et al. | |
| 2016/0322809 | A1 | 11/2016 | Wang et al. | |
| 2017/0122542 | A1 | 5/2017 | Shum | |
| 2018/0054863 | A1 * | 2/2018 | Hu | H02M 1/32 |

* cited by examiner

LED DRIVER FOR LED LIGHTING UNITS FOR REPLACING A HIGH-INTENSITY DISCHARGE LAMP

CROSS-REFERENCE TO PRIOR APPLICATIONS

This application is the U.S. National Phase application under 35 U.S.C. § 371 of International Application No. PCT/EP2020/054247, filed on Feb. 18, 2020, which claims the benefits of European Patent Application No. 19167246.8, filed on Apr. 4, 2019, and Chinese Patent Application No. PCT/CN2019/075605, filed on Feb. 20, 2019. These applications are hereby incorporated by reference herein.

FIELD OF THE INVENTION

The present invention relates to the field of LED drivers, and in particular to the field of LED drivers for LED lighting units for retrofitting to a power source designed for a high-intensity discharge lamp.

BACKGROUND OF THE INVENTION

In the field of lighting, there has been a growing interest in LED lighting units for replacing or retrofitting older lighting units, and in particular high-intensity discharge (HID) lamps. These retrofit LED lighting units need to be appropriately designed so that they are able to draw power from a power source that was originally designed for powering an HID lamp. Whilst power is ultimately derived from a mains supply, i.e. utility grid, a power source is any source to which an LED driver for an LED lighting unit may connect in an attempt to draw power, e.g. and may comprise the mains supply, ballasts, ignitors and so on.

However, at a time of installing the LED lighting unit, it is recognized that the power source (originally designed for the HID lamp) may be one of a number of different types. A first type of power source, "Type A", is a power source that has been unaltered since its design for providing power to an HID lamp, and comprises an electromagnetic (EM) ballast, ignitor and (optionally) a compensation capacitor. An ignitor circuit is designed to provide one or more high voltage pulses intended to ionize gas in the HID lamp and create a path for electrical current (thereby lighting the HID lamp). A second type of power source, "Type B", is an altered power source in which at least the ignitor (and optionally the ballast and compensation capacitor) have been removed, deactivated, bypassed or are otherwise absent. This may be because the power source was originally designed to connect to an HID lamp having an internal ignitor (and thereby did not require an ignitor in an external power source). In its most basic form, the "Type B" power source is effectively just a mains supply.

Of course, there may be additional sub-types with each type of power source (e.g. each type representing a different RMS voltage level, different circuit arrangement and/or impedance). Each sub-type may, by itself, be considered a type of power source.

There is a desire to provide an LED driver, for use in an LED lighting unit, that is capable of appropriately driving at least one LED using different types of power sources originally designed for an HID lamp, and in particular using either a "Type A" or "Type B" power source. However, such LED drivers have been difficult to design due to the conflicting preferences for driving from these different power sources.

SUMMARY OF THE INVENTION

The invention is defined by the claims.

According to examples in accordance with an aspect of the invention, there is provided an LED driver for generating an output power for driving at least one LED from an input power provided by a power source. The LED driver comprises: an input arrangement adapted to receive input power from the power source; an output arrangement adapted to provide output power for driving the at least one LED; first circuitry defining a first current path between the input arrangement and the output arrangement, the first circuitry comprising a first rectifying arrangement connected to the input arrangement; second circuitry defining a second, different current path between the input arrangement and the output arrangement, the second circuitry comprising a second rectifying arrangement connected to the input arrangement; a power source type determiner adapted to determine if the power source is of: a first type, in which the power source comprises a functional ignitor circuit, able to ignite a high-intensity discharge lamp; or a second type, in which the power source comprises no functional ignitor circuits that are able to ignite a high-intensity discharge lamp, and a controller adapted to: direct the current of the input power down the first current path in response to the power source type determiner determining that the power source is of the first type; and direct the current of the input power down the second current path in response to the power source type determiner determining that the power source is of the second type.

The present invention proposes an LED driver that is able to direct current down different paths based on a type of the power source providing power to the LED driver. This means that different components (e.g. rated for the requirements of the different types of power source) can be used without needing to specifically bypass certain components. This improves an efficiency of the LED driver, by reducing losses caused by passing current through certain components. There is therefore provided an improved LED driver capable of operating with different types of power sources of which at least one is originally designed for an HID lamp.

In particular, different circuitry for the LED driver enables different components to be used depending upon a type of the power source, whilst enabling an input arrangement (e.g. comprising a noise filter) and output arrangement (e.g. comprising a buffer or a current control device) to be shared for both types of power source. This provides a compact and low-cost LED driver.

The second circuitry may comprise modifying circuitry connected between the second rectifying arrangement and the output arrangement, the modifying circuitry for modifying characteristics of the input power.

Thus, when the second type of power source is identified (i.e. there are no functional ignitors that are able to modify to the input power), the input power is modified by modifying circuitry. This enables specific circuitry to be provided for each type of power source.

In examples, the modifying circuitry comprises a power factor correction circuit. In particular, the modifying circuitry may comprise a boost converter.

In at least one embodiment, the first circuitry comprises a direct connection between the second rectifying arrangement and the output arrangement. This reduces losses of the input power when the power source is of the first type.

The LED driver may further comprise a shunting arrangement adapted to controllably shunt either the input or the output of the first rectifying arrangement to a ground or reference voltage, wherein, in response to the power source type determiner determining that the power source is of the first type, the controller is adapted to control the shunting arrangement to shunt the input or output of the first rectifying arrangement for a period of time during each half cycle of an input voltage of the input power.

The term "shunt" is here used to mean a step of providing a parallel, low-resistance path to a ground or reference voltage, effectively "shorting". Thus, the input arrangement may be shunted or an output of the first rectifying arrangement may be shunted, effectively shorting the power source.

Optionally, the shunting arrangement comprises a shunting switch adapted to controllably shunt either the input or the output of the first rectifying arrangement to a ground or reference voltage; and a mechanical switch connected in series with the shunting switch and having a greater voltage rating than the shunting switch, wherein the controller is adapted to close the mechanical switch in response to the power source type determiner determining that the power source is of the first type and open the mechanical switch in response to the power source type determiner determining that the power source is of the second type. One example of a mechanical switch is a relay.

When a power source is of a first type, components that pass current of the input power do not need to have a high voltage rating (as high voltages of the input power can be shunted by the shunting arrangement), and may have a rating of no more than 250V. When the power source is of the second type, components subject to the power source voltage need to have a high voltage rating, as the effective voltage they will be subject to is the voltage of a mains supply, which typically requires a voltage rating of at least 600V.

The current shunted by the shunting switch(es) of the shunting arrangement can be quite high, and have a fairly large duty cycle. It would therefore be desirable to provide shunting switches with a relatively low on-resistance to minimize loss.

However, very low-ohmic (low resistance) switches (e.g. MOSFETs) with a high voltage rating are rare and relatively expensive. There is therefore a desire to allow the continued use of low-ohmic switches with a lower voltage-rating switches (which are cheaper) as shunting switches when there is a Type A power source. Use of a mechanical switch enables the shunting switch to be of a lower voltage rating. One example of a mechanical switch is a relay.

The output arrangement may comprise a power converter, which is preferably a buck converter. The output arrangement may comprise a voltage smoothing capacitor for smoothing a power provided by the first circuitry or the second circuitry.

The power converter allows the LED driver to run at different bus voltages, e.g. for different ballast types or for compatibility with different power sources, allowing for optimization of power factor and harmonics per application. It also enables a capacitance of a smoothing capacitor to be reduced, leading to a smaller and cheaper circuit, without increasing ripples in the voltage/current supplied to the LEDs.

In at least one embodiment, the power source type determiner is adapted to detect the occurrence of a pulse in a voltage of the input power, wherein the pulse has a length less than a predetermined length and a magnitude of more than a predetermined magnitude.

There is also proposed an LED lighting unit comprising: any described LED driver; and at least one LED connected to draw power from the output arrangement.

Optionally, the at least one LED comprises: a first string of at least one LEDs; a second string of at least one LEDs; an LED switching arrangement adapted to controllably switch the first string and second string between being connected in series or being connected in parallel, an LED control unit adapted to control the LED switching arrangement to connect the first and second string in parallel in response to the power source being of the first type and connect the first and second string in series in response to the power source being of the second type.

Examples in accordance with another embodiment of the invention provide a method of generating an output power for driving at least one LED from an input power provided by a power source. The method comprises: receiving the input power from the power source at an input arrangement; determining if the power source is of a first type, in which the power source comprises a functional ignitor circuit able to ignite a high-intensity discharge lamp, or of a second type, in which the power source comprises no functional ignitor circuits able to ignite a high-intensity discharge lamp; directing the current of the input power down a first current path, defined by first circuitry connected between the input arrangement and an output arrangement, in response to determining that the power source is of the first type; and directing the current of the input power down a second, different current path, defined by second circuitry connected between the input arrangement and the output arrangement, in response to determining that the power source is of the second type, wherein the output arrangement provides the output power for driving the at least one LED.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which:

FIG. 1 illustrates two types of power sources for which LED drivers according to embodiments are configured to draw power from;

DETAILED DESCRIPTION OF THE EMBODIMENTS

Figure 1:
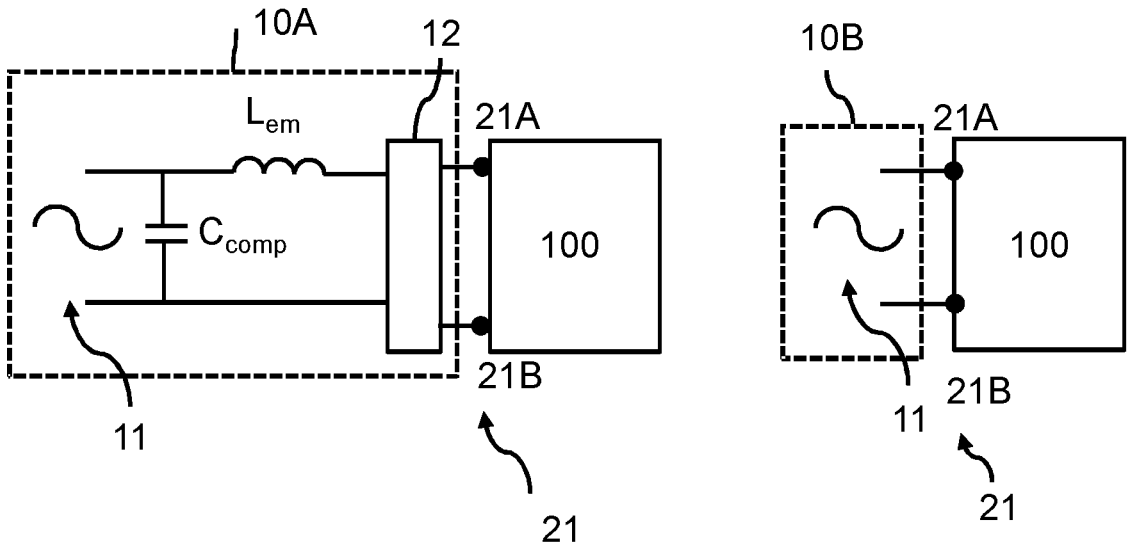

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides an LED driver that is operable with two different types of power source, of which at least one was originally designed for a high-intensity discharge lamp. The LED driver directs current of input power provided by the power source down a first current path if it is determined that the power source comprises a functional ignitor that is able to modify the input power, e.g. to ignite a high-intensity discharge lamp. The LED driver directs current of an input power provided by the power source down a second current path if it is determined that the power source does not comprise a functional ignitor that is able to modify the input power. This means that two different current paths can be specifically designed for each type of power source, whilst enabling some components of the LED driver to be shared.

Embodiments are based on the realization that LED drivers designed to drive an LED arrangement from a power source for a high-intensity discharge lamp have different requirements depending upon the components of the power source, and there is a desire to provide a single LED driver capable of driving an LED arrangement from more than one type of power source. The inventions have recognized that providing two separate current paths, and directing current based on a type of the power source, enables different circuit configurations to be incorporated into a single LED driver.

Embodiments may, for example, be employed in LED lighting units designed to retrofit to a power source originally designed for a high-intensity discharge lamp.

For the sake of clarity, throughout this application an "input power" is used to refer to a power provided by a power source to the LED driver. The input power is associated with an "input current" and "input voltage", which may be referred to as the "(input) current of the input power" and the "(input) voltage of the input power" respectively, for the sake of clarity. Similarly, an "output power" is used to refer to the power provided by the LED driver (e.g. for the LED arrangement). The output power is associated with an "output current" and "output voltage", which may be referred to as the "(output) current of the output power" and a "(output) voltage of the output power" respectively.

FIG. 1 illustrates two types of power source 10A, 10B for powering an LED lighting unit 100. The LED lighting unit 100 connects to an input interface 21 formed of one or more input nodes 21A, 21B, which may be alternatively labelled "input terminals", to draw power from the power source.

A first type of power source 10A is an unmodified power source for a high-intensity discharge (HID) lamp. The power source 10A is formed from a mains supply 11, a (optional) compensator capacitor $C_{comp}$, an electromagnetic (EM) ballast $L_{em}$, and an ignitor 12. When operating, the ignitor 12 creates high frequency and high voltage oscillations designed to light or ignite an HID lamp. The EM ballast $L_{em}$ is designed to regulate a current through the HID lamp whilst the HID lamp outputs light. A compensator capacitor $C_{comp}$ is an AC capacitor designed for individual correction of the power factor of the EM ballast $L_{em}$. A first type of power source may be called a "ballast input".

An LED driver (e.g. formed in the LED lighting unit 100) for converting an input power provided by a power source 10A of the first type to an output power for driving LEDs typically uses a shunting arrangement to "short" or ground the input nodes for a period of time during each half cycle of an input voltage of the input power, due to the presence of an ignitor in the power source 10A.

A second type of power source 10B is a modified power source for an HID lamp, in which the compensator capacitor $C_{comp}$, electromagnetic ballast $L_{em}$ and ignitor 12 have been removed (or were never initially present). The second type of power source 10B therefore effectively comprises a mains supply 11. In some embodiments of a power source of second type, the electromagnetic ballast and/or compensation capacitor may still be present. The second type of power source may be called a "mains input".

An LED driver designed for converting input power provided by a power source of the second type to an output power for driving LEDs may comprise a power factor correction circuit (e.g. a boost circuit) for improving a power factor of the input power. This reduces harmonics in the input current (of the input power).

The present invention will generally be explained in the context of the first and second above-described types for a power source (e.g. where a ballast and ignitor are functionally present or absent). However, the invention may be extended to other types of power source (e.g. comprising different types or configurations of ballast and/or ignitor).

In particular, embodiments of the present invention provide an LED driver capable of operating with both the first and second type of power source, at least one of which was originally designed for powering an HID lamp, whilst resolving the conflicting requirements of such LED drivers.

Figure 2:
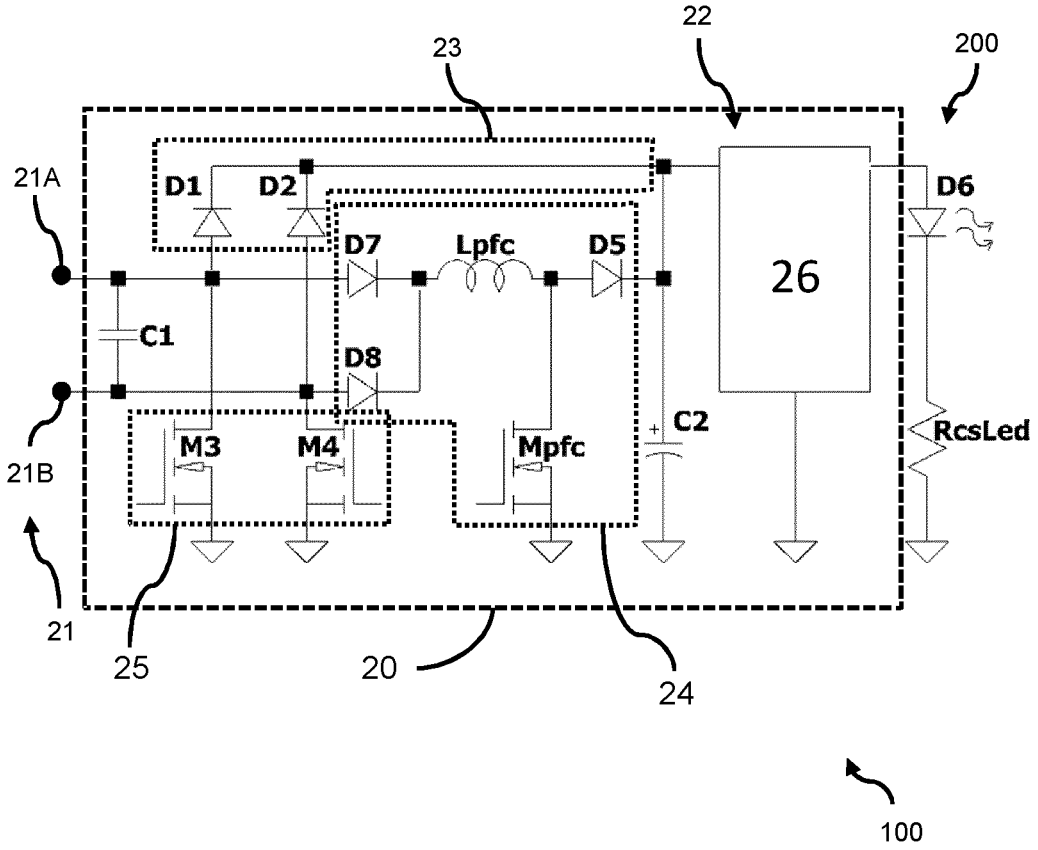
FIG. 2 is a circuit diagram illustrating an LED driver according to a first embodiment of the invention.

FIG. 2 is a circuit diagram illustrating an LED driver 20, for driving an LED arrangement 200 formed of at least one LED D6, according to a first embodiment of the invention. The LED driver 20 and LED arrangement 200, formed of at least one LED D6, together form an overall LED lighting unit 100.

The LED driver 20 comprises an input arrangement 21 arranged to receive input power from a power source (not shown). The input arrangement 21 comprises a first input node 21A and a second input node 21B. The two nodes are adapted to receive a differential power signal from the power source (not shown). The input arrangement 21 further comprises a decoupling capacitor C1 connected between the first and second input node, the decoupling capacitor being designed to suppress high-frequency noise in the input signal. The decoupling capacitor is optional, and may, for example, be replaced by a noise filtering circuit (or be absent entirely).

The LED driver 20 also comprises an output arrangement 22 arranged to provide an output power for driving the at least one LED D6. Here, the output arrangement 22 provides a single voltage level for driving the LED arrangement. To reduce ripple, the LED driver may comprise a smoothing capacitor C2 disposed before the output arrangement for smoothing the input power. This capacitor C2 thereby effectively stores a voltage for driving the LED arrangement, and decouples the input power from the output power.

The input power is AC and the output power is effectively DC (potentially with a small voltage ripple). Thus, the LED driver acts as an AC-DC converter.

The LED driver comprises first circuitry 23 that defines a first current path between the input arrangement 21 and the output arrangement 22. The first circuitry comprises a first rectifying arrangement D1, D2 connected to the input arrangement. Here, the first circuitry also comprises a direct connection (e.g. a wire) connecting the output of the first rectifying arrangement D1, D2 to the output arrangement 22. Thus, input power is provided directly to the output arrangement if current is directed down the first current path.

The LED driver also comprises second circuitry 24 that defines a second current path between the input arrangement 21 and the output arrangement 22. The second circuitry 24 comprises a second rectifying arrangement D7, D8 connected to the input arrangement. Here, the second circuitry comprises (optional) modifying circuitry in the form of a power factor correction circuit Lpfc, Mpfc, D5 which is controllable for modifying a power factor of the input power when it is passed through the second current path. The illustrated power factor correction circuit is a boost circuit. Thus, the input current is modified by modifying circuitry if the current of the input power is directed down the second current path.

The LED driver further comprises a power source type determiner (not shown) adapted to determine if the power source is of: a first type, in which the power source comprises a functional ignitor circuit, for igniting a high-intensity discharge lamp, able to modify the input power; or a second type, in which the power source comprises no functional ignitor circuits able to modify the input power. An explanation of the first and second types of power sources for an HID lamp has previously been provided. Suitable embodiments for a power source type determiner will be explained later in this description.

The LED driver yet further comprises a controller (not shown) adapted to: direct the current of the input power down the first current path in response to the power source type determiner determining that the power source is of the first type; and direct the current of the input power down the second current path in response to the power source type determiner determining that the power source is of the second type.

Thus, the controller may operate in a "first control mode", in which the current of the input power is directed down the first current path and a "second control mode" in which the current of the input power is directed down the second current path. The controller operates in the first control mode when the power source is determined to be of the first type and operates in the second control mode when the power source is determined to be of the second type.

In the illustrated example, to control down which current path the current of the input power is directed, when operating in the second control mode, the controller causes the power factor correction circuit Lpfc, Mpfc to operate as a boost circuit (e.g. through appropriate control of the switch Mpfc). When the power factor correction circuit operates in this way, the voltage at the cathode of D1 and D2 will be higher than the voltage at either anode of D1 and D2 (as the voltage across the smoothing capacitor C2 will be boosted above the voltage level supplied by the power source). Thus, D1 and D2 will naturally turn off, and current will be directed down the second current path (i.e. through diodes D7 and D8).

It will be clear that, when the controller does not cause the power factor correction circuit to operate as a boost circuit (e.g. by rendering switch Mpfc non-conductive, i.e. off/open), then the current will be directed down the first current path (through diodes D1, D2), being the path of least impedance. This is because the path via D1, D2 only induces a single diode voltage drop (of D1 or D2) rather than the two diode voltage drops of D7/D8 and D5. Moreover, the inductor $L_p$fc will have a greater natural resistance than a wire, increasing an impedance of the path via D7/D8. In some embodiments, such as those later illustrated, the second circuitry 24 may comprise additional components (e.g. an EMI filter) that would further increase the impedance through the path via D7/D8.

In this way, the controller can direct the current path of the current of the input power through appropriate control of the circuitry. In particular, the controller can direct the current path of the input power without the need for dedicated switches, e.g. specifically for blocking current from going down a particular path, as it has been recognized that the current path can be automatically directed through use of the power factor correction circuitry. This reduces a complexity, cost and losses (due to switch impedance) of the LED driver. Thus, circuitry originally designed for use with the second type of power source (i.e. the power factor correction circuit) can also be used to automatically draw/direct current down a current path.

However, other methods of controlling down which current path the current of the input power is directed will be apparent to the skilled person, e.g. by controlling appropriately placed switches, e.g. to bypass or limit access to certain diodes or rectifying arrangements. Thus, it is not essential to include a power factor correction circuit.

Thus, the input arrangement 21 and output arrangement 22 are used regardless of the type of power source. This means that some components have a multi-purpose and can thereby reduce the cost, size and complexity of the LED driver.

It would be particularly beneficial to enable the input power to be controllably shunted to a reference voltage or ground when the power source is of the first type. Thus, the LED driver 20 may further comprise a shunting arrangement 25 adapted to controllably shunt the input of the first rectifying arrangement to ground or a reference voltage. Here, the shunting arrangement is formed of a first shunting switch M3 that connects the first input node 21A to ground and a second shunting switch M4 that connects the second input node 21B to ground. Thus, the shunting arrangement may be integrated into a bridge of the LED driver.

Alternatively, the shunting arrangement 25 may be connected to an output of the first rectifying arrangement, as illustrated in a later embodiment. In this case, there may be a further diode or rectifier connected between the shunting arrangement and the output arrangement 22.

The LED driver can be appropriately controlled depending upon the detected type of the power source, not only to direct the current down an appropriate current path, but to enable appropriate driving of the LED arrangement based on different power source types.

In particular, when operating in the first control mode, the controller controls the shunting arrangement 25 to shunt the input power for a period of time during each half cycle of an input voltage of the input power.

As the duty-cycle during which current flows through D1 or D2 during this first control mode is relatively small, and the voltage across the smoothing capacitor C2 voltage is relatively low (about 33% of that during the second control mode), the D1, D2 current tends to be higher than a normal peak current limitation of the power factor correction circuit Lpfc, Mpfc, D5 (i.e. the current Lpfc should be able to handle without saturating). Hence, during the first control mode, the majority of the input current flows via D1 or D2, even if the PFC is still active.

However, in some embodiments, the controller may, when operating in the first control mode, open the switch Mpfc, i.e. make the switch Mpfc non-conductive, so that the power factor correction circuit is not operational).

In some other embodiments, during the first control mode, the controller may control an operation of the power factor correction unit Lpfc, Mpfc, D5 (by appropriately controlling the switch Mpfc) to discharge C1 in a resonant fashion. This allows lossless limited dV/dt discharge of decoupling capacitor C1 (for audible noise suppression). This can be achieved when the power factor correction unit is designed to be able to run at a high peak current, roughly three times the peak current in the ballast of a connected power source, without Lpfc saturating and with Mpfc being able to handle the same high peak currents. At the start of a shunting action during the first control mode, the voltage across the decoupling capacitor C1 is approximately equal to the C2 voltage. In this embodiment, when initiating a shunting action, the power factor correction unit is controlled so that the high-frequency current through the inductor $L_{pfc}$ is substantially equal to the full momentary EM ballast current plus an additional current to discharge C1 towards 0. When the C1 voltage reaches zero, e.g. at the moment the C1 voltage equals zero, the operation of the power factor correction unit can be stopped (e.g. by making the switch Mpfc non-conductive), and both M3 and M4 can be made conductive to thereby shunt or short the input power. It will be appreciated that this significantly increases the complexity of the first control mode.

Appropriately controlled shunting of a power source (of the first type) enables control over the total amount of charge (e.g. the current) provided to the smoothing capacitor C2, and thereby defines the voltage stored across the capacitor C2. This helps to increase the efficiency of the LED driver, as is known in the art.

In particular, the control of the shunting arrangement may be performed to keep the (e.g. rectified mean or average, such as RMS) voltage across the smoothing capacitor (i.e. provided to the output arrangement) at a predetermined level, to maintain a predetermined current through an LED D6 or the overall LED arrangement 200 (e.g. which can be monitored by a sensing resistor RcsLed) or to shunt the input power for a predetermined fixed period of time during each half cycle. Keeping the voltage across the smoothing capacitor low also serves to limit the rectified mean or RMS value of the voltage of the input power, thus preventing an ignitor of the power source of the first type from being activated (i.e. prevents the ignitor from generating voltage pulses).

When the controller, operating in the first control mode, of the first embodiment performs shunting, the current of the input power flows through the shunting switches M3 and M4. When the controller, operating in the first control mode, of the first embodiment performs no shunting, the current of the input power flows through either D1 and M4 or D2 and M3, depending on the voltage polarity of the input power at that time.

A controller operating in the second control mode may configure the switch Mpfc to operate the power factor correction circuit as a boost power factor correction circuit. This effectively increases the voltage across the smoothing capacitor C2 compared to the voltage of the input power provided at the input arrangement 21. As previously explained, this process directs the current of the input power down the second current path, as the voltage at the cathode(s) of the first rectifying arrangement D1, D2 will be greater than the voltage at the anode(s) of the first rectifying arrangement.

When operating in the second control mode, the controller is adapted to operate the power factor correction circuit Lpfc, Mpfc, D5 (here a boost converter) to either maintain the voltage across the smoothing capacitor C2 at a fixed level or to maintain a current through the LED at a fixed level (e.g. which can be monitored by a sensing resistor RcsLed). This can be performed through appropriate control of the switch Mpfc for the power factor correction circuit, as would be known to the skilled person.

The controller may also control the shunting arrangement to act as a synchronous rectified bridge during the second control mode, e.g. by causing each of the shunting switches M3, M4 to shunt at a different half cycle of the voltage of the input power. Alternatively, during the second control mode, the shunting arrangement 25 may be inactive (e.g. open switches).

If the shunting arrangement is absent, or is inactive during the second control mode, the input arrangement should further comprise diodes (D3, D4) for providing a route for reverse current (e.g. each diode being connected between ground and a respective input node).

In FIG. 2, if the shunting arrangement is inactive during the second control mode, the body diodes of the shunting switches M3, M4 can provide said route for reverse current.

Thus, the proposed LED driver provides two different control mechanisms, for use with two different types of power source, to define an output voltage provided to an LED arrangement. A first control mechanism uses a shunting arrangement to appropriately shunt an input power for a set or adjustable period during each half cycle of an input voltage of the input power, to thereby define a voltage provided to the LED arrangement. A second control mechanism uses a power factor correction circuit, in particular a boost converter, to define the voltage provided to the LED arrangement. Each control mechanism is associated with a different current path for the input power.

By splitting the current path, so that each part of the current path is used for a different type of power source, components in the split current path only undergo current stress when the driver is operated in a particular control mode. In particular, a current stress in the components of the power factor correction circuit is minimized when operating in the first control mode. In this way, components in the different current paths can be selected, and circuits designed, for a specific type of power source.

By default, the controller may control the LED driver to operate in the second control mode until the type of the power source is determined. This is because the shunting of the first control mode may result in a fuse of the power source being blown, as the shunting/shorting of the input will. Whilst operating in the second control mode may be inefficient (e.g. due to potential activation of an ignitor of the power source), it does not have the potential to destroy or overload components of the power source or LED driver.

The above-described LED driver, up to the point of the output arrangement, is effectively a single stage driver suitable for converting an input power from a power source of the first type or of the second type to an output power for powering an LED. The construction of the output arrangement may result in the LED driver, as a whole, being a multi-stage driver.

In particular, the output arrangement 22 may further comprise a power converter 26, which is preferably a buck converter. A buck converter helps control the LED current.

When the output arrangement 22 comprises a buck converter, the controller, if operating in the first control mode, can control the LED driver to effectively act as a shunt switch with buck topology. This can provide improvements to the power factor and provides reduced total harmonic distortion. Use of a buck converter also enables the inrush current to be reduced in magnitude and/or duration, as well as providing greater selection of the voltage provided to the LED arrangement.

Consider a scenario in which the output arrangement comprises a direct connection to the LED arrangement (i.e. does not comprise a power converter). In this instance, the smoothing capacitor C2 would directly in parallel with the LED arrangement. Thus, any voltage ripple across C2 will result in a (larger) ripple in the LED current. Hence, the capacitance of the smoothing capacitor C2 would need to be large, resulting in an inrush current of substantial magnitude and/or duration.

However, by placing a power converter 26 between smoothing capacitor C2 and the LED arrangement, such as a buck convertor, power converter 26 can adjust its operating point to maintain a constant output current while allowing a larger voltage ripple across C2. Thus, the capacitance of smoothing capacitor C2 can be smaller so that the magnitude and/or duration of the inrush current is reduced.

In particular, the power converter 26 allows the voltage across the capacitor C2 to be decoupled from the voltage provided to the LED arrangement. This enables the power factor and total harmonic distortion to be improved by allowing the voltage across the capacitor C2 to be variable, whilst the buck converter ensures a same/constant voltage is supplied to the LED arrangement. Driver efficiency, when the buck converter is used, can still be sufficiently high to meet legal or customer requirements, since buck efficiency can be greater than 99%. Thus, the total efficiency of the LED circuit can still be at least 94.5%.

However, to provide even greater efficiency of the LED circuit (>95%), the first control mode may be modified so that the LED circuit instead operates as a single stage shunt switch (i.e. by disabling or bypassing the buck converter if present). For example, if a buck converter is present, it may be bypassed using a separate bypass (mechanical) switch/relay or by driving a buck switch continuously in an ON or conductive state.

When the output arrangement 22 comprises a buck converter, the controller, when operating in the second control mode, can operate the LED circuit as a two-stage switched mode power supply, where the boost converter (of the power factor correction circuit Lpfc, Mpfc, D5) acts as a first stage and the buck converter acts as the second stage.

As previously explained, the power converter 26 allows the voltage provided to the LED arrangement 200 to be decoupled from the voltage across the smoothing capacitor C2. This allows allowing for optimization of power factor and harmonics per application (e.g. for different types of power source or different ballast). It also enables a capacitance of the smoothing capacitor C2 to be reduced, leading to a smaller and cheaper circuit, without affecting LED arrangement ripple voltage.

When a power source is of a first type, components that pass or are exposed to a current of the input power do not need to have a high voltage rating (as high voltages of the input power are shunted by the shunting arrangement 25, so that a voltage across the components does not exceed a predetermined voltage), and may have a rating of no more than 250V. When the power source is of the second type, components exposed to the power source typically need to have a high voltage rating (as the effective voltage is the voltage of a mains supply, which typically requires a voltage rating of at least 600V).

The current shunted by the shunting switch(es) of the shunting arrangement 25 can be quite high, and have a fairly large duty cycle. It would therefore be desirable to provide shunting switches with a relatively low on-resistance to minimize loss.

However, very low-ohmic (low resistance) switches (e.g. MOSFETs) with a high voltage rating are relatively rare and expensive. There is therefore a desire to allow the continued use of low-ohmic switches with a lower voltage-rating switches (which are cheaper) as shunting switches.

In a proposed further embodiment, each shunting switch M3, M4 is connected in series with a mechanical switch (not shown) having a greater voltage rating than the respective shunting switch. The controller (not shown) is adapted to close the mechanical switch, thereby making it conductive, when the power source is of the first type and open the mechanical switch, thereby making it non-conductive, when the power source is of the second type. This means that a shunting switch does not need to be rated for a voltage provided by a power source according to the second type, and can therefore be a low-ohmic switch.

This concept of providing a mechanical switch in series with a shunting switch may be adapted for use in any herein described embodiment, e.g. where the switching arrangement is positioned in a different location.

If a mechanical switch is provided in series with the shunting switches M3, M4, the shunting arrangement should comprise diodes (D3, D4), each positioned in parallel to a respective series connection of a shunting switch and mechanical switch, for providing a route for reverse current while operating in the second control mode (i.e. when the power source is of the second type).

Figure 3:
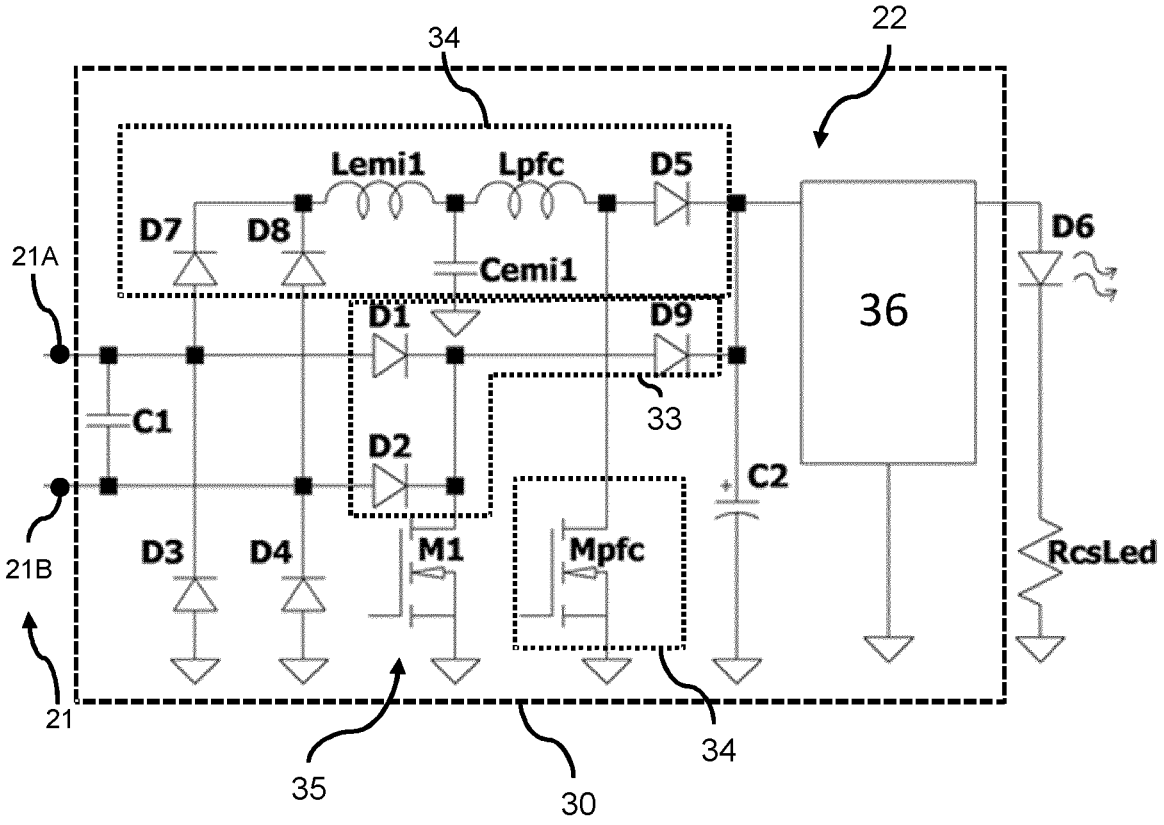
FIG. 3 is a circuit diagram illustrating an LED driver according to a second embodiment of the invention.

FIG. 3 illustrates an LED driver 30 according to a second embodiment of the invention.

The LED driver again comprises an input arrangement 21 and an output arrangement 22, which may be identical to those of the first embodiment. The LED driver 30 also comprises first circuitry 33, through which current flows when the controller operates in the first control mode, and second circuitry 34, through which current flows when the controllers operates in the second control mode.

The LED driver 30 of the second embodiment is distinguished from the LED driver 20 of the first embodiment in that the shunting arrangement 35 has been repositioned to be connected to an output of the first rectifying arrangement D1, D2. This reduces the number of switches (from 2 to 1, where the input is differential) required to shunt the input when the power source is of a first type. Nonetheless, an advantage of providing a shunting switch at an input of the first rectifying arrangement is that there are fewer losses, as the current takes a shorter path thereby incurring less voltage drop and thus less loss.

As the shunting arrangement has been repositioned, additional diodes D3 and D4 have been introduced. These diodes are shared between the first rectifying arrangement D1, D2 and the second rectifying arrangement to provide a path for a reverse current supplied to both rectifying arrangements.

A further diode D9 has been introduced to prevent discharging of the smoothing capacitor C2 via the shunting arrangement when the shunting arrangement shunts the input power to ground. This diode D9 is not required for the first embodiment (as the first rectifying arrangement itself acts to prevent this discharging during shunting).

The LED driver 30 further comprises an electromagnetic interference (EMI) filter formed of an EMI inductor Lemi1 and an EMI capacitor Cemi1. This EMI filter is designed to reduce a noise or distortion of the power source introduced by the power factor correction circuit. The EMI filter is integrated into the second circuitry, rather than at an input arrangement. This is because it is preferable that the current of the input power should not flow through an EMI inductor when the power source is of the first type to reduce loss and due to saturation considerations.

Figure 4:
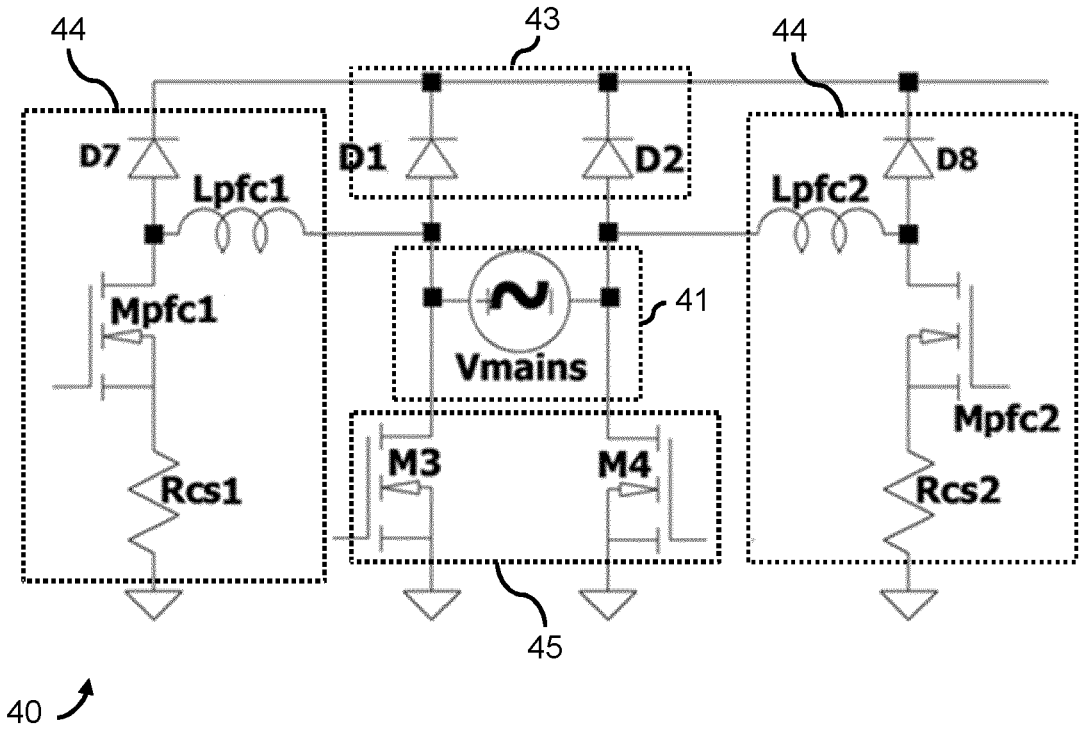
FIG. 4 is a circuit diagram illustrating an LED driver according to a third embodiment of the invention.

FIG. 4 illustrates an LED driver 40 according to a third embodiment of the invention. For this embodiment, the power source Vmains is illustrated.

The LED driver again comprises an input arrangement 41 and an output arrangement (components of which are not shown), which may be identical to those of the first embodiment. The LED driver 40 also comprises first circuitry 43, through which current flows when the controller operates in the first control mode, and second circuitry 44, through which current flows when the controllers operates in the second control mode.

The LED driver differs from the LED driver 20 according to the first embodiment in that the power factor correction circuit of the second circuitry 44 has been integrated into the second rectifying arrangement D7, D8. To accommodate this change in configuration, the power factor correction circuit has been split into a first power factor correction circuit $Lpfc_1$, $Mpfc_1$ and a second power factor correction circuit Lpfc2, Mpfc2.

Each power factor correction circuit may further comprise a current sense resistor Rcs1, Rcs2. This is to enable overcurrent protection of each power factor correction circuit, by enabling the LED driver to sense currents in excess of a safe threshold (i.e. overcurrent) and control the power factor correction circuits appropriately (e.g. make switches Mpfc1, Mpfc2 non-conductive) to account for the overcurrent.

Integrating the power factor correction circuit into the second rectifying arrangement can result in lower losses when operating in the second control mode. This is because there is one diode-drop less in the current path when operating in the second control mode (i.e. diode D5 of FIG. 2 is absent).

It is possible to perform further suppression of electromagnetic interference of the PFC stage, for example, by connecting a respective EMI inductor in series with a respective inductor $Lpfc_1$, Lpfc2 of the power factor correction circuits and a respective EMI capacitor for each power factor correcting circuit, the EMI capacitor being connected between a first node, located between an EMI inductor and an inductor of the power factor correction circuit, and either ground or an input node of an input interface (being the input node of the opposite polarity to that providing power to the associated power factor correcting circuit).

When it is determined that the power source is of the first type, then the switch Mpfc1, Mpfc2 can be controlled to be open (i.e. so that the power factor correction circuits are not operational), and the shunting arrangement 45 can be appropriately controlled to shunt the input power for a period of time during each half cycle of an input voltage of the input power. Appropriately controlled shunting of a power source (of the first type) enables control over the output power provided to the LED arrangement. The control of the shunting arrangement may be performed to maintain a voltage across the smoothing capacitor (i.e. provided to the output arrangement) at a predetermined level.

When it is determined that the power source is of the second type, as previously explained, the switches Mpfc1, Mpfc2 can be controlled to operate each power factor correction circuit as a boost power factor correction circuit. The shunting arrangement can be controlled to act as a synchronous rectified bridge (e.g. each of the shunting switches M3, M4 shunting at a different half cycle of the voltage of the input power). Alternatively, the shunting arrangement 45 may be inactive (e.g. open or non-conductive switches), in which case the body diodes of M3 and M4 can provide a route for reverse current.

In any of the above described embodiments comprising an EMI inductor, it is preferable that the current of the input power should not flow through an EMI inductor when the power source is of the first type. This is due to saturation and loss considerations. Thus, the EMI inductor, and corresponding EMI capacitor, may be appropriately positioned so as to only conduct current when the current of the input power is directed down the second circuitry, e.g. by being positioned in the second circuitry. The EMI inductor and EMI capacitor are then still able to substantially prevent high frequency current contained in the Lpfc inductor current from being extracted from the power source.

Figure 5:
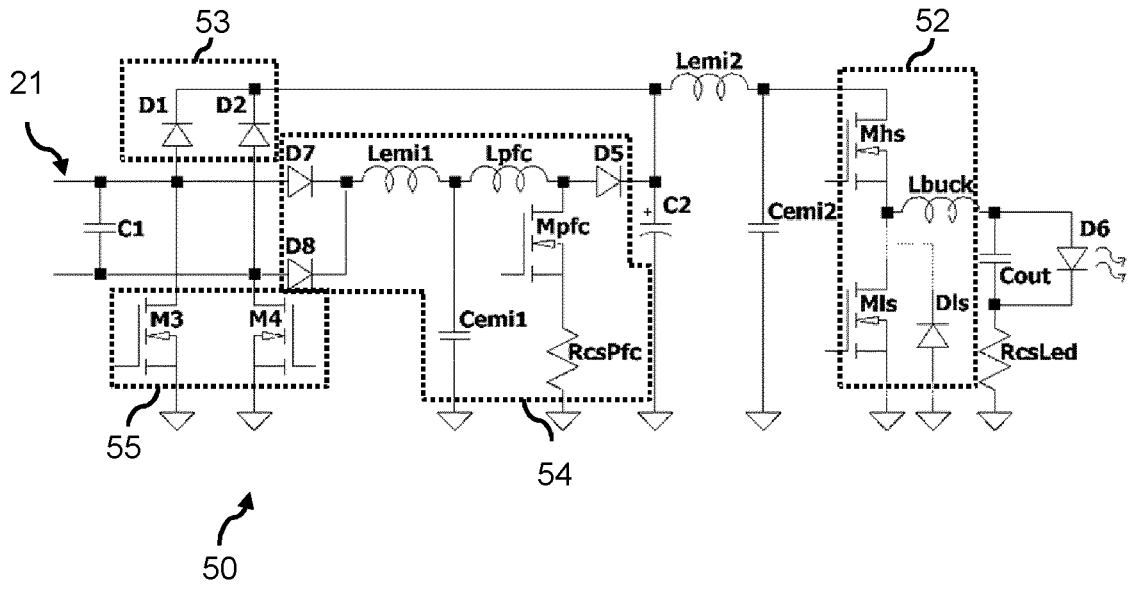
FIG. 5 is a circuit diagram illustrating an LED driver according to a fourth embodiment of the invention.

FIG. 5 illustrates a LED driver 50 according to a fourth embodiment of the invention. This is essentially the LED driver of the first embodiment, with an explicit implementation of a buck converter and additional EMI filters.

The LED driver 50 again comprises an input arrangement 21 and an output arrangement 52, which may be identical to those of the first embodiment. The LED driver 50 also comprises first circuitry 53, through which current flows when the controller operates in the first control mode, and second circuitry 54, through which current flows when the controller operates in the second control mode. The LED driver also comprises a controller (not shown).

The LED driver 50 according to the fourth embodiment illustrates an example of a power converter for the output arrangement.

The illustrated power converter comprises a buck converter, formed of the conventional buck inductor Lbuck, buck switch Mhs and buck diode Dls or synchronous rectifier switch Mls, as known to the skilled person.

The LED driver 50 also differs from the first embodiment by further comprising a pair of electromagnetic interference reducers. Embodiments may comprise neither, either or both of these pairs of EMI reducers.

In particular embodiments, the second circuitry comprises a first electromagnetic interference reducing circuit Lemi1, Cemi1. The inductor Lemi1 of the first electromagnetic interference reducing circuit is connected in series with the inductor Lpfc of the power factor correction circuit. The capacitor Cemi1 of the first electromagnetic interference reducing circuit is connected between an output of the inductor Lemi1 and ground.

The LED driver further comprises a second electromagnetic interference reducing circuit Lemi2, Cemi2. The second electromagnetic interference reducing circuit is formed at an input to the output arrangement, i.e. after the first and second circuitry have reconnected. In particular, the second electromagnetic interference reducing circuit is located between the smoothing capacitor C2 and the output arrangement 52.

The capacitance of the capacitor Cemi2 of the second electromagnetic interference reducing circuit is (much) less than the capacitance of the smoothing capacitor C2.

When operating in the first control mode, the first electromagnetic interference reducing circuit Lemi1, Cemi1 has no effect. Thus, the second electromagnetic interference reducing circuit Lemi2, Cemi2 should filter the EMI introduced by the buck converter. Preferably, this filtering is performed above the EM-ballast resonant frequency (i.e. of the ballast included in the power source of the first type).

The second electromagnetic interference reducing circuit is placed "after" the smoothing capacitor C2 (i.e. the smoothing capacitor is connected between an input of the second electromagnetic interference reducing circuit and a ground/reference voltage). This avoids the need for potentially high-peak currents, which may occur when operating in the first control mode, to flow through the second electromagnetic interference reducing circuit Lemi2, which would cause extra losses due to the series resistance of the inductor Lemi2 and may cause said inductor Lemi2 to saturate (at times that EMI suppression is required).

By placing the EMI-2 filter "after" C2 only the much smaller, almost DC current discharging C2 and flowing towards the buck converter 52 is flowing through Lemi2 during the first control mode.

When operating in the second control mode, the first electromagnetic interference reducing circuit $L_{emi1}$, and $C_{emi1}$ forms the primary EMI filter, and the second electromagnetic interference reducing circuit $L_{emi2}$ and $C_{emi2}$ are predicted to have negligible additional effect.

The output current of the second circuitry (i.e. the D5 current) contains a DC component (equal to the DC component of the current provided to the buck convertor), low-frequency components (primarily the 2nd harmonic of the power source voltage frequency) and high-frequency components (the Mpfc switching frequency and its higher harmonics). During the second control mode, the DC component of the output current of the second circuitry flows through Lemi2 but not the low frequency components.

Figure 6:
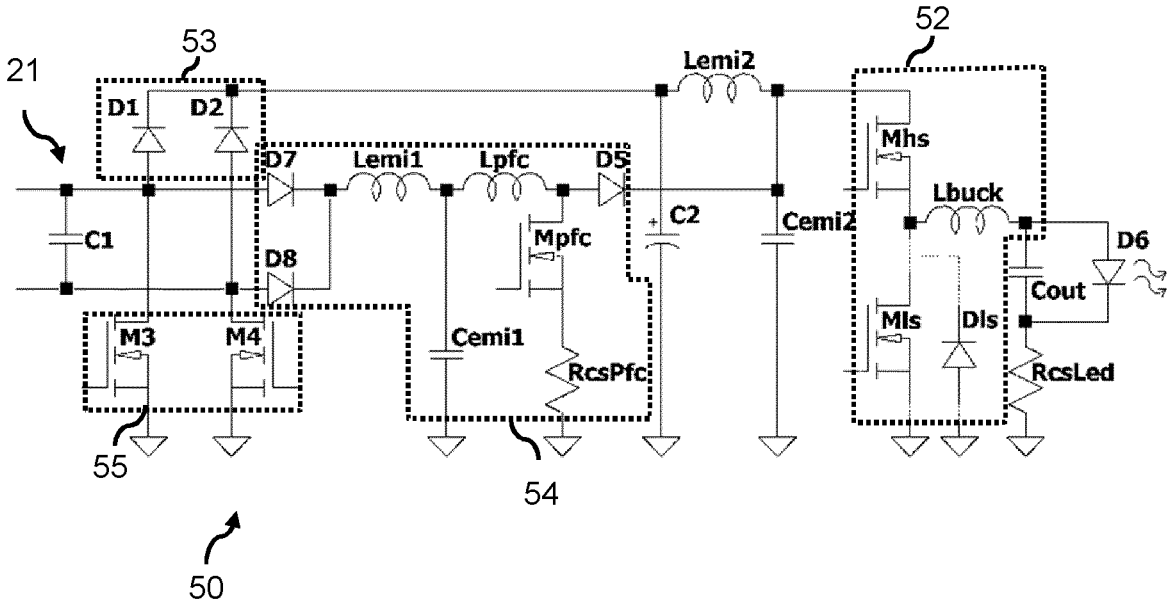
FIG. 6 is a circuit diagram illustrating an LED driver according to a fifth embodiment of the invention.

FIG. 6 illustrates an LED driver 60 according to a fifth embodiment of the invention.

The LED drive of the fifth embodiment differs from the LED driver of the fourth embodiment in that the output of the second circuitry 64 is instead connected to an output of the second electromagnetic interference reducing circuit Lemi2, Cemi2 (rather than an input). Thus, the output of the second circuitry is connected between the second electromagnetic interference reducing circuit Lemi2, Cemi2 and the output arrangement 52.

As the capacitance of the smoothing capacitor C2 capacitance is (much) bigger than the Cemi2 capacitance, the majority of the low frequency component will flow into C2 via Lemi2 (as the EMI-2 filter only filters out "higher" frequencies), but not the DC component. For the high-frequency components there is not much difference whether the current flows through C2 or Cemi2.

When compared to the LED driver 50 according to the fourth embodiment (in which, during the second control mode, the DC component of the output of the second circuitry flows through Lemi2 but not the LF components), the functionality of the fifth embodiment is slightly more efficient.

However, for the fifth embodiment operating in the second control mode, the second electromagnetic interference reducing circuit is less effective for filtering out buck convertor induced noise than the fourth embodiment. However, the first electromagnetic interference reducing circuit can be designed so as to be effective in filtering both the power factor correction circuit Lpfc, Mpfc, D5 and buck convertor 52 induced noise.

Figure 7:
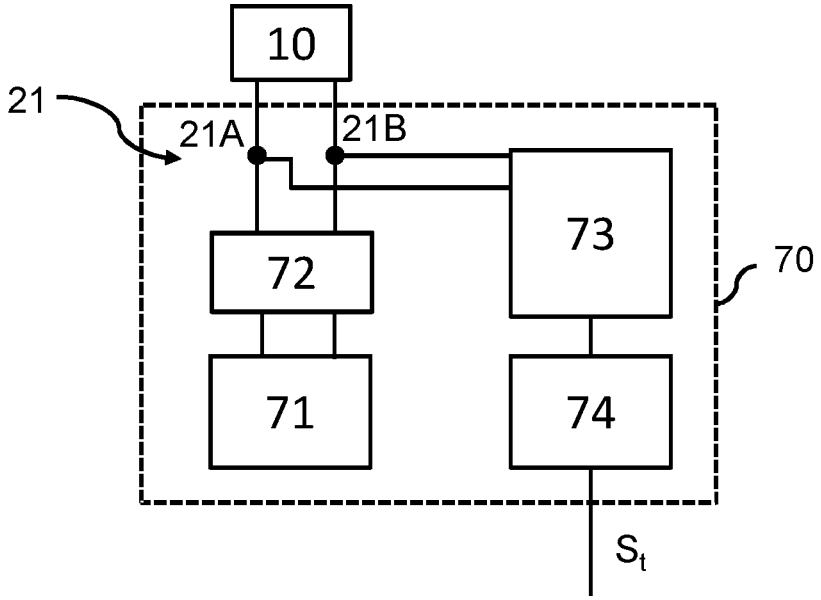
FIG. 7 illustrates a power source type determiner according to an embodiment of the invention.

FIG. 7 is a block diagram illustrating a power source type determiner 70 according to an embodiment.

The power source type determiner 70 may comprise a load 71 for drawing power from the power source 10. The load may comprise any suitable component for drawing power, such as a resistor or other impedance arrangement. In embodiments, as later described, the load may comprise the LED arrangement of an LED lighting unit.

The power source type determiner 70 may also comprises a power control arrangement 72 adapted to control a level of the power drawn by the load. By way of example, the power control arrangement may comprise a switch for connecting or disconnecting the load from the power source (to switch between a first power level, e.g. no power, and at least a second, different power level). The power control arrangement may be responsive to a manual switch (e.g. a light switch) or to a signal from a controller (not shown), which is designed to automatically test the type of the power source.

The power source type determiner also comprises a monitoring system 73 adapted to monitor an electrical parameter of the load or of the power source. For example, as illustrated, the monitoring system may monitor a voltage level provided by the power source to the load 71. Other examples will be set out below.

The power source type determiner further comprises a type determination unit 74 adapted to receive, from the monitoring system 73, a first value and a second value of the electrical parameter. The first value is obtained whilst the load draws a first power level and the second value is obtained after the power control arrangement has switched a power drawn by the load from the first power level to the second power level and the power source type determiner then processes the first and second values, e.g. a difference or delta between the first and second values, to generate a type indicating signal $S_t$ indicating the type of the power source for powering the LED lighting unit.

In particular embodiments, the second value of the electrical parameter is obtained during a start-up process of the power source (i.e. during a period immediately after a level of power provided to the load has changed). For example, a start-up process may cover a period in which an ignitor of the power source is operating. Thus, the start-up process may be associated with a certain period of time.

The type indicating signal $S_t$ may, for example, be a binary signal indicating whether the power source is the first type or the second type. This binary signal can be passed to a controller and used to control the operation of any previously described LED driver.

Thus, the power source type determiner 70 effectively determines a type of the power source. In particular, the power source type determiner may be able to distinguish between a power source of a first type 10A (comprising at least an ignitor and a ballast) and a power source of a second type 10B (in which the ignitor and ballast are absent or are otherwise unable to generate ignition pulses).

In particular, the monitoring system 73 may be adapted to monitor an electrical characteristic that differs depending on whether a power source comprises an ignitor/ballast or not. Examples of such electrical characteristics include a change in magnitude of a voltage level provided by the power source (e.g. as an input power) in response to a change in the power drawn by a load, a change in phase of the input current or voltage (in response to a change in the amount of power drawn by a load), or pulses/spikes in the power provided by a power source (indicative of the presence of an ignitor in the power source).

In a first example, the power control arrangement is adapted to controllably switch a power drawn from the load between a first power level (e.g. no power, where the load does not draw power), and a second, different power level (e.g. full power where the load draws power). In particular examples, the power control arrangement may controllably connect and disconnect the load from the input arrangement.

The monitoring system 73 may measure a root mean square (RMS) voltage between the nodes 21A, 21B of the input arrangement 21 whilst the load 71 draws a first power level and whilst the load 71 draws a second, higher power level. Thus, two measurements or values of the RMS voltage may be generated. In particular, a first value represents an RMS voltage when the load 71 draws a first power level and a second value represents an RMS voltage when the load 71 draws a second, higher power level (after the switching arrangement changes the power drawn by the load).

The difference between the first and second values is indicative of the type of the power source. In particular, where the power source is of the second type (e.g. not comprising a ballast or ignitor) the first value of the RMS voltage will be substantially identical (e.g. ±5%) to the second value of the RMS voltage. Where the power source is of the first above-type (e.g. comprising a ballast and ignitor), the first value of the RMS voltage will be more (e.g. by more than a predetermined amount, such as 5% or 10%) than the second value of the RMS voltage. This is because there will be a voltage drop across at least the EM ballast.

Thus, by monitoring a change in the RMS voltage provided at an input interface 21 for the LED lighting unit, when there is a change in the amount of power drawn by a load 71 connected thereto, a distinction can be made between different types of power source. In particular, a distinction can be made as to whether or not a power source comprises a (functional) ballast.

Where the first power level is no power (i.e. zero), the first value will be substantially the same for different power sources, and will typically be similar or identical to the mains supply voltage, as no/negligible current flows in the EM ballast (caused by the drawing of power by a connected load). Where the first power level is no power, and the second power level is an amount of power (e.g. full power), the second value will change based on the type of the power source, as the EM ballast will cause a voltage drop as the load draws more power.

The type indicating signal $S_t$ can thereby be controlled based on the change in the RMS voltage provided at an input interface for the LED lighting unit.

A further distinction can be made based on a magnitude of a difference between the first and second values. In particular, the magnitude of the change in RMS voltage can inform whether the change is substantially similar (e.g. so that the power source is of the second type), whether the change is in a first range fitting a first group of one or more EM ballasts (e.g. having a small voltage drop), whether the change is in a second range fitting a second group of one or more EM ballasts (e.g. having a large voltage drop) and so on. In this way, not only can a distinction between a first and second type of power source be determined, but if the power source is of a first type, then a sub-type can also be determined, where each sub-type represents (a group of) power sources (of the first type) with different ballasts.

In a second example, a shift in phase of a monitored voltage or current level (e.g. at the input interface 21 is monitored by the monitoring system 73 and used to identify the type of power source. In such an embodiment, a time reference may be established whilst the load draws a first power level (e.g. no power), e.g. via a phase locked loop. The load is then configured to draw a second, different power level (e.g. draws full power), and a shift in phase is determined.

Where the power source is of the second type (e.g. not comprising a ballast or ignitor) the shift in phase will be negligible (e.g. ±1%). Where the power source is of the first type (e.g. comprising a ballast and ignitor), the shift in phase will be noticeable (e.g. more than a predetermined amount, such as more than 5% or 10%). This is because the voltage drop across the EM ballast will cause a noticeable shift in the phase in the sensed signal as the power level changes.

Again, in case the power source is of a first type, the magnitude of the shift in phase can even tell us if the change is in the range fitting a first group of one or more EM ballasts, a second group of one or more EM ballasts or neither of the two.

Thus, the first and second examples provide a simple method of detecting whether a power source comprises a (functional) ballast that is able to modify a voltage, current or power provided to a connected load (i.e. is a "first type") or does not comprise such a ballast (i.e. is a "second type"). The type indicating signal $S_t$ may carry information (e.g. a binary signal) indicating the type of the power source.

A further distinction of the type of ballast, and thereby type of power source, can also be made, which distinction may also be carried by the type indicating signal.

The first and second examples thereby share a same idea of making a step in the load (and thereby power drawn) that the power source type determiner forms at its input interface 21, and establishing the delta/change in a particular electrical parameter (e.g. voltage, current and/or phase) of the load or power source. Based on said delta/change in the sensed signal(s), a type of the power source can be determined.

Another parameter that could be monitored to distinguish between a first and second type of power source is the presence of absence of pulses or spikes during a start-up process of the power source (i.e. during a time immediately after a load attempts to start drawing power). The presence of spikes or pulses (e.g. of at least a predetermined magnitude and below a predetermined length in time) is indicative of the presence of an ignitor in the power source and thereby indicates whether the power source is of the first type or not. The absence of such spikes indicates that the power source is of the second type.

In this way, the characteristics of the power source during a start-up process, e.g. immediately after the load begins drawing power, can be used to identify at least whether the power source is of the first or second type.

Other examples of a power source type determiner will be apparent to the skilled person. In another simple embodiment, the power source type determiner may be a simple toggle switch that is operated by a user to define the type of the power source, so that the determiner determines a state of the toggle switch.

In yet another embodiment, the type determiner may comprise a non-volatile memory, such as flash memory, containing configuration data. This configuration data may be written to the non-volatile memory, e.g. via near field communication (NFC), e.g. at the time of installation of the LED driver 20, when the type of power source (and possibly the sub-type) the LED driver will be connected to is known. In this way, a user may determine and define the type of the power source.

Figure 8:
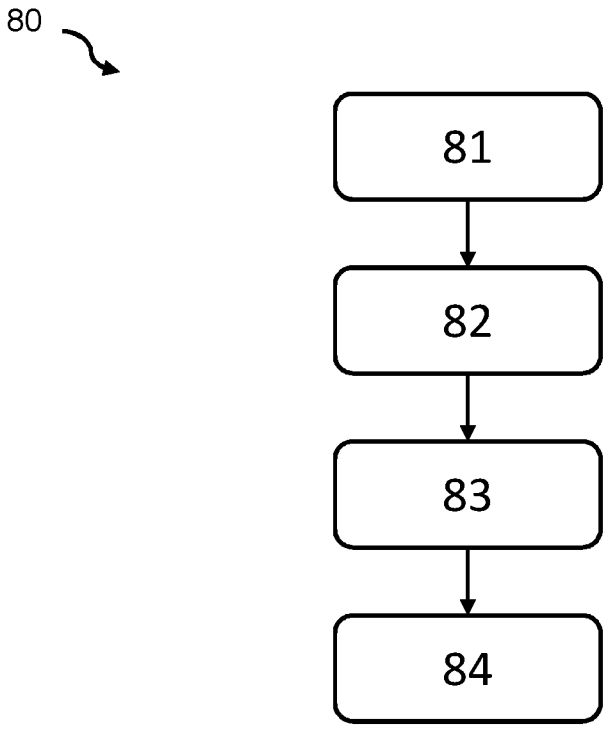
FIG. 8 is a flowchart illustrating a method according to an embodiment of the invention.

FIG. 8 illustrates a method 80 according to an embodiment of the invention.

The method 80 comprises a step 81 of receiving the input power from the power source at an input arrangement.

The method 80 further comprises a step 82 of determining if the power source is of a first type, in which the power source comprises a functional ignitor circuit able to ignite a high-intensity discharge lamp or of a second type, in which the power source comprises no functional ignitor circuits that are able to ignite a high-intensity discharge lamp.

The method 80 further comprises a step 83 of directing the current of the input power down a first current path, defined by first circuitry connected between the input arrangement and an output arrangement, in response to determining that the power source is of the first type.

The method further comprises a step 84 of directing the current of the input power down a second, different current path, defined by second circuitry connected between the input arrangement and the output arrangement, in response to determining that the power source is of the second type. The output arrangement provides the output power for driving the at least one LED.

Figure 9:
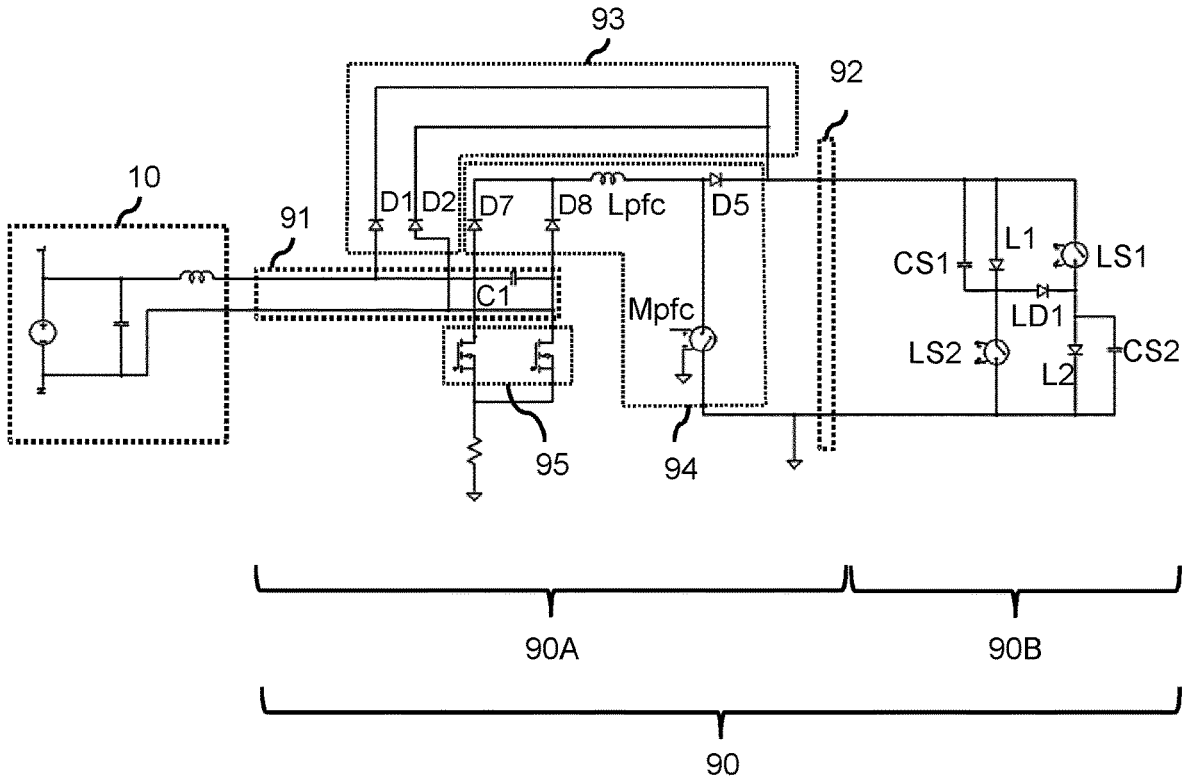
FIG. 9 is a circuit diagram illustrating a LED lighting unit according to an embodiment.

FIG. 9 illustrate an LED lighting unit 90 according to a sixth embodiment of the invention. The LED lighting unit comprises an LED driver 90A (such as any of those previously described) and an LED arrangement 90B.

The illustrated LED driver 90A comprises an input arrangement 91 (for receiving input power from a power source 10) and an output arrangement 92 for providing output power to the LED arrangement 90B. The input arrangement 91 comprises a coupling capacitor C1 for reducing noise in the input power.

The LED driver comprises first circuitry 93 forming a first current path, comprising a first rectifying arrangement D1, D2, connecting the input arrangement 91 to the output arrangement 92. A controller of the LED driver (not shown) directs the current of the input power down the first circuitry current path in response to a power source type determiner (not shown) determining that the power source comprises a functional ignitor.

The LED driver comprises second circuitry 94 forming a second current path, comprising a second rectifying arrangement D7, D8 and modifying circuitry Lpfc, Mpfc, D5, connecting the input arrangement 91 to the output arrangement 92. The modifying circuitry here comprises a power factor correction circuit. A controller of the LED driver (not shown) directs the current of the input power down the first circuitry current path in response to a power source type determiner (not shown) determining that the power source comprises a functional ignitor.

Thus, the LED driver 90 is almost identical to the LED driver 20 of the first embodiment.

As a boost converter is used during a second control mode (and not used in the first control mode), there may be a voltage difference between the output voltage provided by the LED circuit when the controller operates in the first control mode compared to the second control mode. To take account of this difference, and to ensure a consistent operation of the LED arrangement, it would be preferable to control the forward voltage of the LED arrangement.

The LED arrangement 90B comprises a first LED array L1 and a second LED array L2, each LED array being formed of at least one LED. The LED lighting unit further comprises a switching arrangement LS1, LS2 configured to control whether the first L1 and second L2 LED arrays are connected in series or in parallel. In particular, the switching arrangement LS1, LS2 may be able to control or define a forward voltage of the LED arrangement.

In the illustrated example, the switching arrangement LS1, LS2 is configured to be switchable between at least a first switching mode, in which the first and second LED arrays are connected in parallel by making both switches of the switching arrangement conductive, and a second switching mode, in which the first and second LED arrays are connected in series by making both switches of the switching arrangement non-conductive. The first switching mode provides an LED arrangement with a lower forward voltage than the second switching mode.

An LED diode LD1 prevents the LED lighting unit from short circuiting when both switches LS1, LS2 of the switching arrangement are conductive. Smoothing capacitor CS1, CS2 are also switched between operating in series or parallel (depending upon the switching mode).

Optionally, the controller, if operating in the first control mode, controls the switching arrangement to be in the first switching mode and, if operating in the second control mode, controls the switching arrangement to be in the second switching mode. This allows the controller to control the forward voltage across the LED arrangement to be switched between a first and second, higher value. In particular, this enables for different voltages to be provided to the LED arrangement without affecting an operation of the LED arrangement (e.g. current through the LEDs or an amount of output light). This enables two different control mechanisms and/or converters to be used.

Thus, the first and second strings are connected in parallel in response to the power the power source being of the first type and are connected in series in response to the power source type being of the second type.

The LED controlling aspect of the controller may be referred to as an LED control unit. The LED control unit may be formed separately to the remainder of the controller.

The LED circuit of the sixth embodiment also differs from the first embodiment in that the buffer capacitor is shifted to the LED arrangement, and is split. In particular, a first buffer capacitor CB1 is connected in parallel with the first LED array and the second buffer capacitor CB2 is connected in parallel with the second LED array. Splitting the buffer capacitor reduces an inrush current through the LED array(s) if the LED circuit switches from the second control mode to the first control mode, but is not essential.

The above described LED arrangement (having a switching arrangement) is not required if the output arrangement comprises a buck converter, as the buck converter can perform the controlling or defining of the current provided to the LED arrangement (thereby avoiding a need to have an LED arrangement with a changeable forward voltage). Other methods of controlling the voltage provided to the LED arrangement would be apparent to the skilled person, e.g. using a boost converter.

As discussed above, embodiments make use of a controller. The controller can be implemented in numerous ways, with software and/or hardware, to perform the various functions required. A processor is one example of a controller which employs one or more microprocessors that may be programmed using software (e.g., microcode) to perform the required functions. A controller may however be implemented with or without employing a processor, and also may be implemented as a combination of dedicated hardware to perform some functions and a processor (e.g., one or more programmed microprocessors and associated circuitry) to perform other functions.

Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media such as volatile and non-volatile computer memory such as RAM, PROM, EPROM, and EEPROM. The storage media may be encoded with one or more programs that, when executed on one or more processors and/or controllers, perform the required functions. Various storage media may be fixed within a processor or controller or may be transportable, such that the one or more programs stored thereon can be loaded into a processor or controller.

It will be understood that disclosed methods are preferably computer-implemented methods. As such, there is also proposed the concept of computer program comprising code means for implementing any described method when said program is run on a computer. Thus, different portions, lines or blocks of code of a computer program according to an embodiment may be executed by a processor/computer to perform any herein described method.

As used herein, the term "functional ignitor" or "functional ignitor circuit" refers to an ignitor present in the power source that has not been removed, bypassed or otherwise deactivated. Thus, a functional ignitor is able to (if triggered) inject voltage pulses into a (voltage of a) power provided to a device connected to the power source.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. If a computer program is discussed above, it may be stored/distributed on a suitable medium, such as an optical storage medium or a solid-state medium supplied together with or as part of other hardware, but may also be distributed in other forms, such as via the Internet or other wired or wireless telecommunication systems. If the term "adapted to" is used in the claims or description, it is noted the term "adapted to" is intended to be equivalent to the term "configured to". Any reference signs in the claims should not be construed as limiting the scope.

The invention claimed is:

1. An LED driver for generating an output power for driving at least one LED from an input power, provided by a power source originally designed for powering a high-intensity discharge lamp, the LED driver comprising:

an input arrangement adapted to receive the input power from the power source;

an output arrangement adapted to provide the output power for driving the at least one LED;

first circuitry defining a first current path between the input arrangement and the output arrangement, the first circuitry comprising a first rectifying arrangement arranged to connect the input arrangement to the output arrangement;

second circuitry defining a second, different current path between the input arrangement and the output arrangement, the second circuitry comprising a second rectifying arrangement and a modifying circuit arranged to connect the input arrangement to the output arrangement;

a power source type determiner adapted to detect an occurrence of a pulse in a voltage level of the input power and adapted to determine if the power source is of:

a first type, in which the power source comprises a functional ignitor circuit able to ignite the high-intensity discharge lamp if the pulse has a length less than a predetermined length and a magnitude of more than a predetermined magnitude; or a second type, in which the power source comprises no functional ignitor circuits able to ignite the high-intensity discharge lamp, a controller adapted to:

direct the current of the input power down the first current path in response to the power source type determiner determining that the power source is of the first type; and direct the current of the input power down the second current path in response to the power source type determiner determining that the power source is of the second type.

2. The LED driver of claim 1, wherein the second circuitry comprises modifying circuitry connected between the second rectifying arrangement and the output arrangement, the modifying circuitry being adapted to modify characteristics of the input power.

3. The LED driver of claim 2, wherein the modifying circuitry comprises a power factor correction circuit.

4. The LED driver of claim 2, wherein the modifying circuitry comprises a boost converter.

5. The LED driver of claim 1, wherein the first circuitry comprises a direct connection between the first rectifying arrangement and the output arrangement.

6. The LED driver of claim 1, further comprising a shunting arrangement adapted to controllably shunt either the input or the output of the first rectifying arrangement to a ground or reference voltage, wherein, in response to the power source type determiner determining that the power source is of the first type, the controller is adapted to control the shunting arrangement to shunt the input or output of the first rectifying arrangement for a period of time during each half cycle of an input voltage of the input power.

7. The LED driver of claim 6, wherein the shunting arrangement comprises:

a shunting switch adapted to controllably shunt either the input or the output of the first rectifying arrangement to a ground or reference voltage; and a mechanical switch connected in series with the shunting switch and having a greater voltage rating than the shunting switch, wherein the controller is adapted to close the mechanical switch in response to the power source type determiner determining that the power source is of the first type and open the mechanical switch in response to the power source type determiner determining that the power source is of the second type.

8. The LED driver of claim 1, wherein the output arrangement comprises a power converter, preferably wherein the power converter comprises a buck converter.

9. The LED driver of claim 1, further comprising a smoothing capacitor for smoothing an output of the first circuitry or the second circuitry.

10. An LED lighting unit comprising:

the LED driver of claim 1; and the at least one LED connected to draw power from the output arrangement.

11. The LED lighting unit of claim 10, wherein the at least one LED comprises:

a first LED string;

a second LED string;

an LED switching arrangement adapted to controllably switch the first LED string and second LED string between being connected in series or being connected in parallel, an LED control unit adapted to control the LED switching arrangement so as to connect the first LED string and second LED string in parallel in response to the power source type determiner determining that the power source is of the first type and to control the LED switching arrangement so as to connect the first LED string and second LED string in series in response to the power source type determiner determining that the power source is of the second type.

12. A method of generating an output power for driving at least one LED from an input power provided by a power source, the method comprising:

receiving the input power from the power source at an input arrangement;

determining if the power source is of a first type using a power source type determiner, adapted to detect an occurrence of a pulse in a voltage level of the input power, in which the power source comprises a functional ignitor circuit able to ignite a high-intensity discharge lamp if the pulse has a length less than a predetermined length and a magnitude of more than a predetermined magnitude or of a second type, in which the power source comprises no functional ignitor circuits that are able to ignite the high-intensity discharge lamp;

directing the current of the input power down a first current path, defined by first circuitry arranged to connect the input arrangement to the output arrangement, in response to determining that the power source is of the first type; and directing the current of the input power down a second, different current path, defined by second circuitry arranged to connect the input arrangement to the output arrangement, in response to determining that the power source is of the second type, wherein the output arrangement provides the output power for driving the at least one LED, wherein the power source type determiner is adapted to detect the occurrence of a pulse in a voltage level of the input power, and wherein the pulse has a length less than a predetermined length and a magnitude of more than a predetermined magnitude.

* * * * *